US008556747B2

(12) United States Patent
Hung et al.

(10) Patent No.: US 8,556,747 B2
(45) Date of Patent: Oct. 15, 2013

(54) METHOD AND APPARATUS FOR SMOKE EMITTING GOLF BALL

(75) Inventors: Chun-Te Hung, Yun-lin Hsien (TW); Chen-Tai Liu, Yun-lin Hsien (TW); Cheng-Hao Liao, Yun-lin Hsien (TW)

(73) Assignee: NIKE, Inc., Beaverton, OR (US)

( * ) Notice: Subject to any disclaimer, the term of this patent is extended or adjusted under 35 U.S.C. 154(b) by 79 days.

(21) Appl. No.: 13/086,209

(22) Filed: Apr. 13, 2011

(65) Prior Publication Data

US 2012/0264540 A1 Oct. 18, 2012

(51) Int. Cl.
*A63B 43/06* (2006.01)

(52) U.S. Cl.
USPC ..... 473/353

(58) Field of Classification Search
USPC ..... 473/353
See application file for complete search history.

(56) References Cited

U.S. PATENT DOCUMENTS

| | | | |
|---|---|---|---|
| 1,583,721 | A | 5/1926 | Schuyler |
| 1,664,397 | A | 4/1928 | Bens |
| 1,773,197 | A | 8/1930 | Mulcahy |
| 1,819,352 | A | 8/1931 | Bates |
| 2,763,246 | A | 9/1956 | Raskin |
| 3,150,875 | A | 9/1964 | Searles |
| 3,233,544 | A | 2/1966 | Hosoya |
| 3,678,855 | A | 7/1972 | Semel |
| 4,564,199 | A | 1/1986 | Adams |
| 4,614,340 | A | 9/1986 | Hosoya |
| 4,741,717 | A | 5/1988 | Wolf |
| 7,727,097 | B2 | 6/2010 | Siegel et al. |

FOREIGN PATENT DOCUMENTS

| | | |
|---|---|---|
| CN | ZL2012201513691.1 | 1/2013 |
| JP | 51136816 | 11/1976 |
| JP | 6327795 | 11/1994 |
| JP | 9028835 | 2/1997 |
| JP | 2000140161 | 5/2000 |
| JP | 2000146749 | 5/2000 |
| JP | 2003062124 | 3/2003 |
| JP | 2005335998 | 12/2005 |

OTHER PUBLICATIONS

International Search Report and Written Opinion in European Patent Application No. 12164011.4, mailed on Aug. 12, 2012.
Office Action in Canadian Patent Application No. 2772325, mailed on Jun. 8, 2012.
Notification of Grant in Chinese Utility Model Application No. 201220151691.1, issued on Aug. 29, 2012.
Extended European Search Report in European Patent Application No. EP12164011.4, mailed on Aug. 20, 2012.
Notice of Allowance for Canadian Patent Application No. 2772325, mailed on Oct. 1, 2012.

*Primary Examiner* — Raeann Gorden
(74) *Attorney, Agent, or Firm* — Plumsea Law Group, LLC

(57) ABSTRACT

A method and apparatus for causing smoke to emit from a golf ball. In one embodiment, when a partition is removed and a threshold pressure has been met, a chemical reaction may occur between solid compositions. In another embodiment, when a threshold pressure is met to allow a liquid composition to be released from a check valve, a reaction may occur between the liquid composition and a separate solid or liquid composition. In either case, the chemical reaction may result in smoke being emitted from the golf ball, thereby helping a golfer find the ball. The golf ball may be capable of multiple emissions of smoke intermittently.

11 Claims, 17 Drawing Sheets

METHOD AND APPARATUS FOR SMOKE EMITTING GOLF BALL

BACKGROUND

The present invention relates generally to a method and apparatus for emitting smoke from a golf ball.

It is common for a golfer to spend some time looking for his or her ball on the golf course. Some methods have tried to make golf balls easier to find using sight, sound, or smell. However, many of these methods fail to make the ball substantially easier to find. Other methods fail to be useful after a single use.

SUMMARY

The invention generally provides a method and apparatus for emitting smoke from a golf ball on an intermittent basis. The golf ball contains multiple sources of smoke-producing materials and/or sources of the smoke-producing materials which may be accessed or mixed together multiple times. The release of the smoke may be triggered by the impact of a club with the ball or by a user manually manipulating the smoke-producing device in the ball, such as by removing a tab, inserting the ball in water, or otherwise allowing the smoke-producing device in the ball to emit smoke.

Another aspect of the invention provides a method of increasing the visibility of a golf ball, the method comprising the steps of: providing a golf ball configured to emit smoke produced by the reaction of a chemical composition contained within the golf ball, wherein the smoke is emitted after each of several club strikes; directing a user to cause a reaction with a first portion of the chemical composition to produce the smoke for a first strike; and directing a user to cause a reaction with a second portion of the chemical composition to produce the smoke for a second strike.

Another aspect of the invention provides a golf ball including a cover, a core, and a chamber configured to produce smoke. A first portion of the chamber comprises a first composition and a second portion of the chamber comprises a second composition. The chamber includes one or more check valves, wherein the one or more check valves may release a portion of the first composition from the first portion of the chamber into an area where the portion of the first composition is combined with at least a portion of the second composition, wherein the combination of the first composition and the second composition causes an emission of smoke, and wherein the golf ball is configured to emit smoke after each of multiple strikes.

Another aspect of the invention provides a golf ball having a cover, a core, and a chamber, wherein the chamber is configured to produce smoke. The chamber comprises a plurality of solid compositions, one or more removable partitions elements, one or more other partition elements, wherein striking the golf ball causes a chemical reaction that generates smoke, wherein at least one of the removable partition elements is configured to be removed prior to striking the golf ball to cause the chemical reaction, wherein the golf ball is capable of emitting smoke after multiple strikes.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
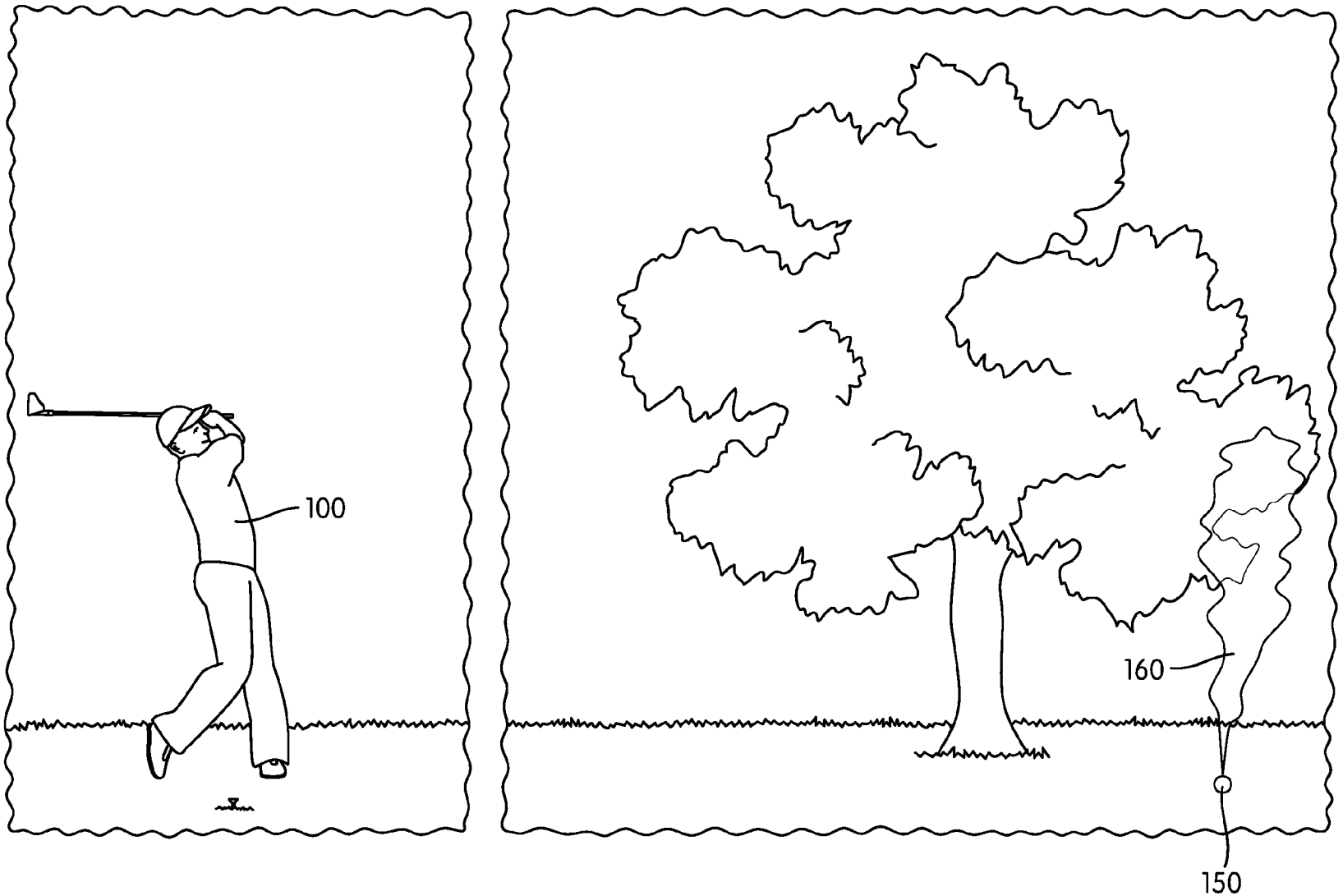
FIG. 1 is a schematic view of a golfer using a golf ball according to an embodiment of the invention.

FIG. 1 is a schematic view of a golfer 100 using a golf ball 150 according to a first embodiment of the invention. Golf ball 150 may include provisions for making itself more visible to golfer 100. Generally, golf ball 150 may emit a smoke 160, which smoke is generally visible to golfer 100. Smoke 160 may be any color including, but not limited to, yellow, green, red, orange, blue, purple, pink, white, black, and combinations of these colors. In some embodiments, smoke 160 may be emitted in response to pressure generated inside golf ball 150 after golf ball 150 is struck by golfer 100. In some embodiments, smoke 160 will not be emitted unless golf ball 150 is struck with adequate force to create a pressure which meets or exceeds a predetermined threshold pressure. In other embodiments, smoke 160 may be emitted as a result of substantially any amount of pressure, jarring of the ball, or impact force.

Smoke 160 may be emitted at various times and for various durations. For example, smoke 160 may be emitted from golf ball 150 substantially immediately after golf ball 150 is struck. In other embodiments, smoke 160 may be designed to be emitted at any point during the trajectory of golf ball 150. In other cases, visible smoke 160 may be designed to be emitted after golf ball 150 has landed. Additionally, smoke 160 may be produced for any length of time, from less than 1 second to multiple seconds to more than a minute or even longer. However, in some embodiments, the production and emission of smoke is designed to end before golfer 100 lines up to take his or her next shot. In such an embodiment, the production of smoke 160 may be less than two minutes in duration.

Golf ball 150 may include provisions for emitting smoke after multiple strikes. Generally, golf ball 150 may include compositions that are not completely consumed during one strike. Accordingly, a fraction of the composition may be used during each strike allowing golf ball 150 to emit smoke on multiple occasions. In some cases, golfer 100 may be able to control whether a composition is used when golf ball 150 is struck. Such embodiments are discussed in greater detail in the upcoming figures.

Figure 2:
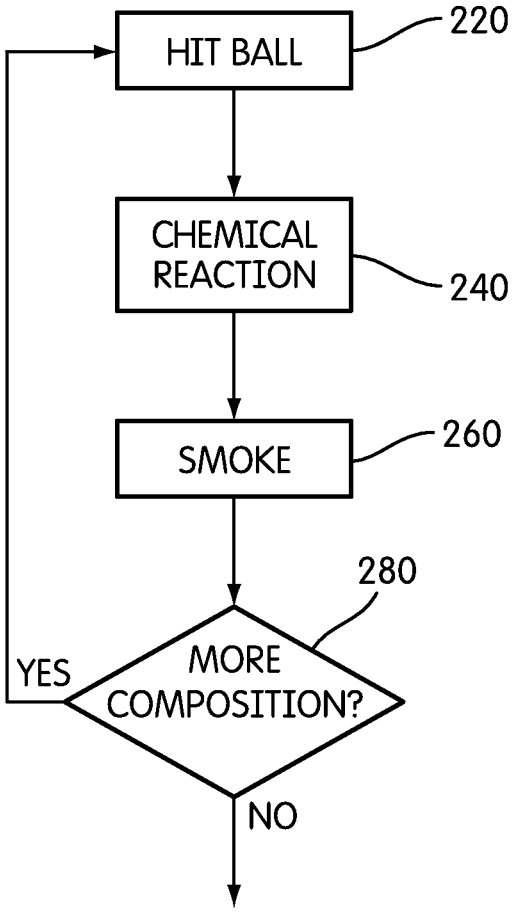
FIG. 2 is a process according to an embodiment of the invention.

FIG. 2 shows a process according to an embodiment of the invention. In some cases, some of the following steps may be accomplished by golf ball 150. It will be understood that in other embodiments one or more of the following steps may be optional or the steps may occur in a different order.

In step 220, golf ball 150 is struck. Golf ball 150 may be struck by any club including, but not limited to, a wood or an iron. In some cases, only certain clubs may typically be capable of delivering adequate pressure to golf ball 150 to produce smoke.

In step 240, a chemical reaction may occur. The chemical reaction may be from one chemical or multiple chemicals. It will be appreciated that any number or type of chemicals capable of causing the desired reaction may be used.

In step 260, smoke 160 is emitted. Any type or amount of smoke may be emitted. Smoke 160 may be visible in any color. In some cases, smoke 160 may also create a sound or be include a detectable smell.

In step 280, it is determined whether more composition exists within golf ball 150. If more composition exists, golf ball 150 may be capable of generating further chemical reactions. Accordingly, the process proceeds to step 220 where golf ball 150 may be struck again to ultimately produce smoke 160. Alternatively, if no more composition exists, then golf ball 150 may be incapable of generating further smoke. It will be appreciated that golf ball 150 may still be capable of use even though smoke will not be emitted, for example, where golf ball 150 is played like a conventional golf ball.

Figure 3:
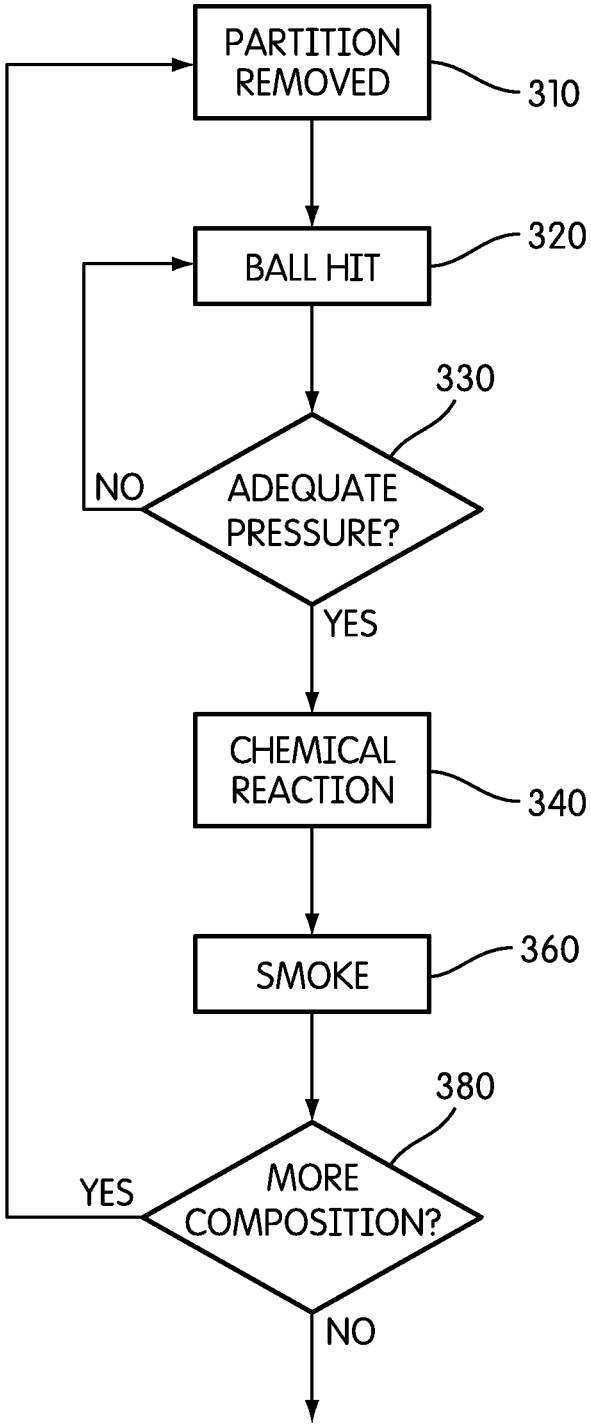
FIG. 3 is a process according to another embodiment of the invention.

FIG. 3 shows a process according to another embodiment of the invention. In some cases, some of the following steps may be accomplished by golf ball 150. It will be understood that in other embodiments one or more of the following steps may be optional or that the steps may occur in a different order.

In step 310, a partition may be removed by golfer 100. In some cases, the partition may be a physical device that separates compositions for the purpose of inhibiting a chemical reaction. By choosing whether to remove the partition, golfer 100 may be capable of choosing whether smoke 160 is emitted from golf ball 150. In other cases, the partition may be removed by varying degrees so golfer 100 can choose the amount of composition that is no longer inhibited from creating a chemical reaction. Accordingly, golfer 100 may be able to choose how much smoke is emitted during each strike or the number of strikes golf ball 150 is capable of generating smoke 160.

In step 320, golf ball 150 is struck, similar to step 220 in FIG. 2. In step 330, it is determined whether adequate pressure has been applied to golf ball 150. In embodiments that follow the process shown in FIG. 3, golf ball 150 may only emit smoke 160 if a certain threshold pressure has been met or exceeded. In some embodiments, the threshold pressure may be set such that smoke 160 is only emitted during a long drive. In other embodiments, the threshold pressure may be set such that a longer shot with an iron may emit smoke 160. In other embodiments, balls may be designed specifically for varying playing levels. For example, the threshold pressure may be higher to require a professional level drive to emit smoke 160. In other embodiments, an amateur level drive may deliver the threshold pressure. In other embodiments, a professional or amateur level iron shot may deliver the threshold pressure. In still other embodiments, golfer 100 may be able to alter the pressure required for golf ball 150 to emit smoke 160. If adequate pressure is delivered to golf ball 150, the process shown in FIG. 3 proceeds to step 340. Otherwise, the process shown in FIG. 3 reverts back to step 320 until the ball is again struck.

In step 340, a chemical reaction occurs similar to step 240 in FIG. 2. In step 360, smoke 160 is emitted similar to step 260 in FIG. 2. In step 380, it is determined whether composition still exists in golf ball 150. If composition still exists, the process proceeds to step 310. Otherwise, golf ball 150 may be incapable of emitting further smoke 160 and, therefore, may be used as a typical golf ball without emitting smoke.

Figure 4:
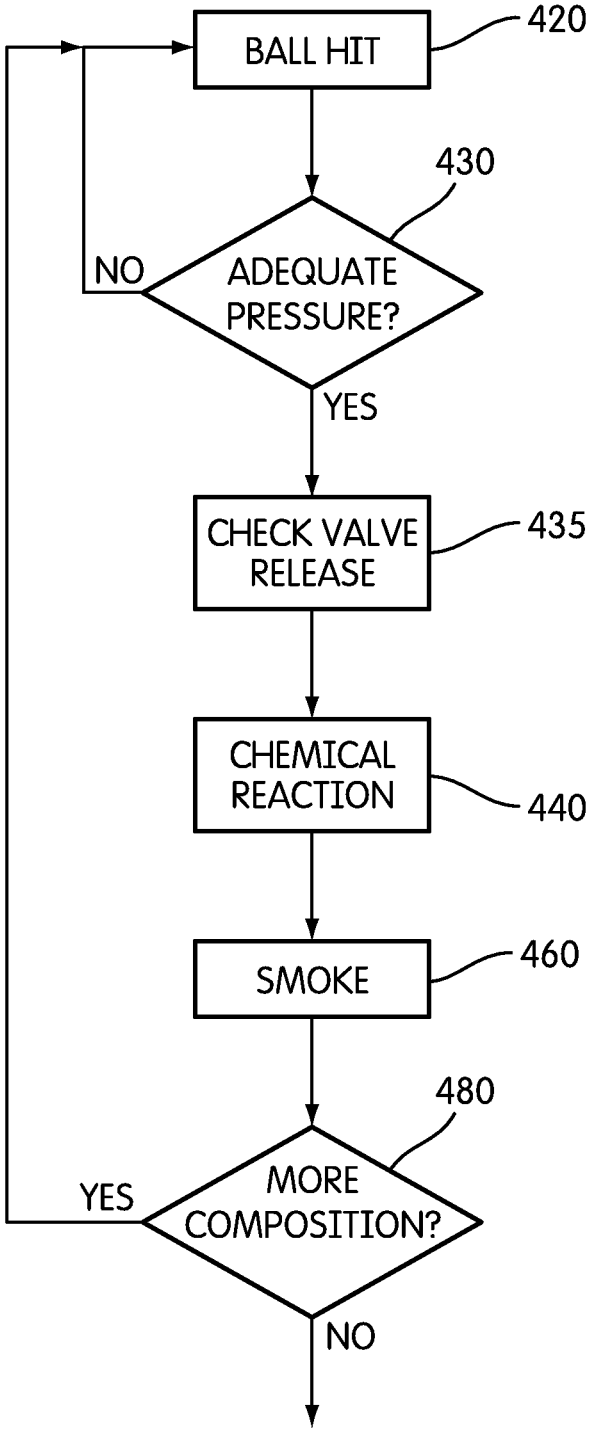
FIG. 4 is a process according to another embodiment of the invention.

FIG. 4 is a process according to still another embodiment of the invention. In some cases, some of the following steps may be accomplished by golf ball 150. It will be understood that in other embodiments one or more of the following steps may be optional or that the steps may occur in a different order.

Steps 420 and 430 are similar to steps 320 and 330 in FIG. 3, respectively. In step 435, a check valve is released. The check valve may comprise one or more check valves and may be any of several types of check valves. As assured by step 430, the check valve may require that a threshold pressure be met. In some cases, the check valve may be a barrier preventing two or more chemicals from combining, thereby inhibiting a chemical reaction. Accordingly, when a check valve is released, the check valve may allow chemicals to combine.

In step 440, a chemical reaction occurs. The chemical reaction may be caused by the combination of compositions resulting from the released check valve in the previous step.

In step 460, smoke 160 may be emitted similar to steps 260 and 360 in FIGS. 2 and 3, respectively. In step 480, it is determined whether a composition still exists in golf ball 150. If a composition exists, the process proceeds to step 420. Otherwise, golf ball 150 may be incapable of emitting further smoke 160 and, therefore, may be used as a typical golf ball without emitting smoke.

It will be appreciated that in any of the embodiments of a process discussed above or below with respect to golf balls that emit smoke, a user may also physically shake a ball in order to trigger or enhance mixing or to complete the partition removal process.

Figure 5:
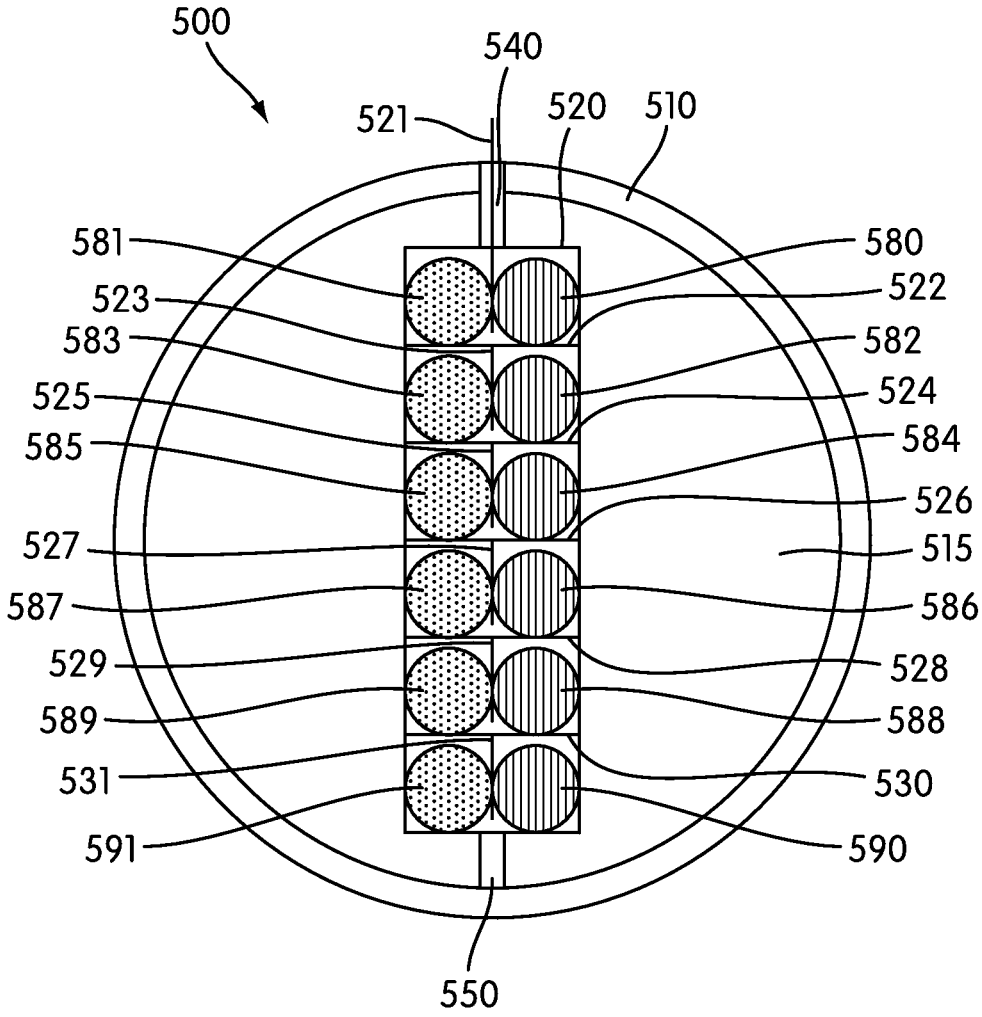
FIG. 5 shows a cross-sectional view of a golf ball as an embodiment of the invention.

FIG. 5 shows a cross-sectional view of a golf ball as an embodiment of the invention. Golf ball 500 may include provisions for storing compositions that may be used to cause chemical reactions. Generally, golf ball 500 may comprise core 515 and cover 510. The core 515 and cover 510 may be manufactured using any known method with any materials. For example, core 515 and cover 510 may be made from thermoset material such as polyurethane elastomers, polyamide elastomers, polyurea elastomers, diene-containing polymer, crosslinked metallocene catalyzed polyolefin, rubber and rubber compostions, and silicone. In other cases, core 515 and cover 510 may be made from thermoplastic material such as ionomer resin, highly neutralized acid polymer composition, polyamide resin, polyester resin, polyurethane resin or a mixture thereof.

Core 515 and cover 510 may be manufactured using any conventional techniques, such as compression molding or injection molding techniques. Dimples may be provided on the outer surface of cover 510. Golf ball 500 may undergo traditional processes such as primer coating, printing, and top coating.

Chamber 520 may be embedded in core 515. Chamber 520 may be able to discharge air or smoke through an aperture 540 in cover 510. Chamber 520 may comprise a plurality of partition elements. In some cases, support element 550 may be added to make chamber 520 stay in the proper position in the ball fabrication process.

As illustrated, chamber 520 comprises removable partition element 521, first partition element 522, second partition element 523, third partition element 524, fourth partition element 525, fifth partition element 526, sixth partition element 527, seventh partition element 528, eighth partition element 529, ninth partition element 530, and tenth partition element 531, herein collectively referred to as the partition elements. In some cases, a removable partition element may be removed by golfer 100 manually. As illustrated, only removable partition element 521 is removable, but it will be appreciated that in other embodiments, multiple partition elements may be removable. The remaining non-removable partition elements will be called other partition elements, herein. The term non-removable does not indicate that a partition element may not be removed, but that it may not be removed manually.

The partition elements may be used to separate first solid composition 580, second solid composition 581, third solid composition 582, fourth solid composition 583, fifth solid composition 584, sixth solid composition 585, seventh solid composition 586, eighth solid composition 587, ninth solid composition 588, tenth solid composition 589, eleventh solid composition 590, and twelfth solid composition 591, herein collectively referred to as the solid compositions. It is to be appreciated that each or any of the solid compositions may be in a form of fine or coarse powder, pellet, or other solid configuration. For example, the solid compositions may comprise, but are not limited to, sulfur and calcium carbide, or any other solid chemicals with similar effect. While twelve solid compositions are illustrated, it will be appreciated that eight, ten, fourteen or any other number of solid compositions may be present. Similarly, any number of partition elements may be present to separate the solid compositions.

In some embodiments, first solid composition 580 and second solid composition 581 may be separated by removable partition element 521. Removable partition element 521 may be removed through any means including, but not limited to, placing the ball in water or another solution capable of dissolving removable partition element 521, pulling removable partition element 521 out of the ball, or pushing removable partition element 521 with a tool. In some cases, first partition element 522 may separate first solid composition 580 and second solid composition 581 from the remaining solid compositions.

Figure 6:
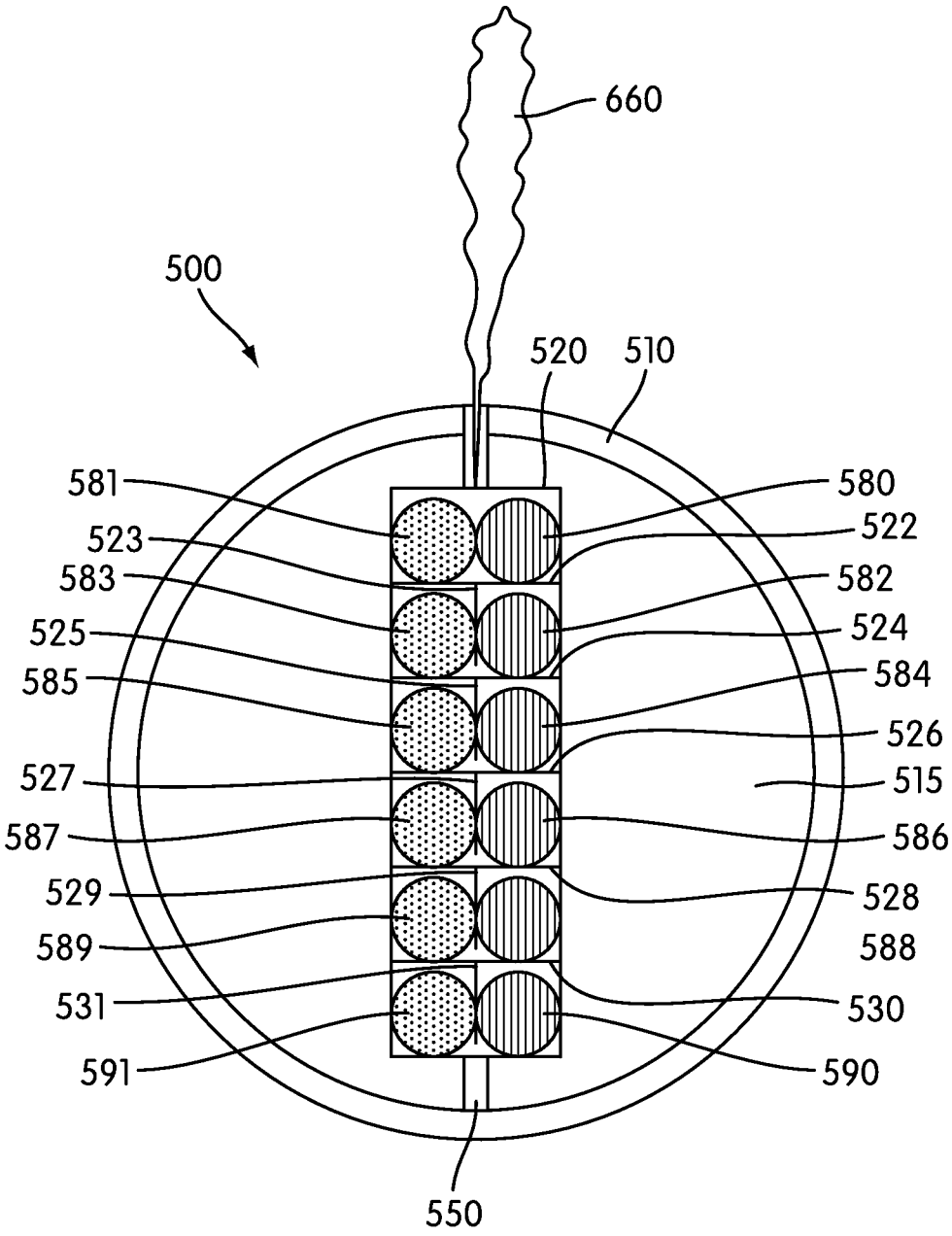
FIG. 6 shows a cross-sectional view of a golf ball as an embodiment of the invention with a removable partition element being removed.

FIG. 6 shows a cross-sectional view of a golf ball with removable partition element 521 removed as an embodiment of the invention. Before golfer 100 hits ball 500, he or she may choose to remove removable partition element 521 so that first solid composition 580 and second solid composition 581 are not inhibited from interacting with each other. After ball 500 undergoes an impact from a golf club, first solid composition 580 and second solid composition 581 may interact. Accordingly, ball 500 may produce a chemical reaction. The chemical reaction may result in an emission of smoke 610.

Figure 7:
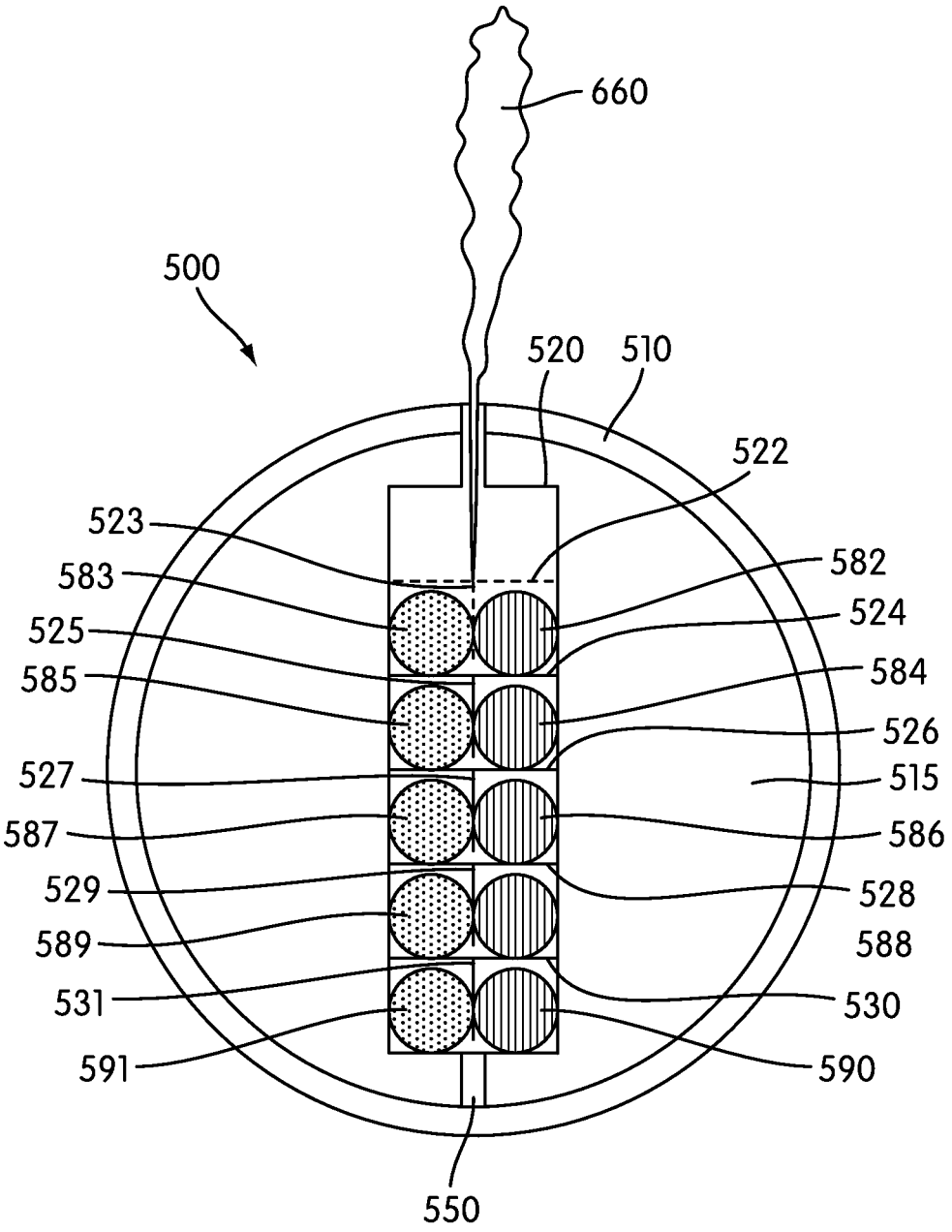
FIG. 7 shows a cross-sectional view of a golf ball as an embodiment of the invention with other partition elements being removed.

FIG. 7 shows a cross-sectional view of a golf ball after a chemical reaction as an embodiment of the invention. In one embodiment, first partition element 522 and second partition element 523 may have relatively low melting points. Accordingly, when first solid composition 580 and second solid composition 581 react, the reaction may also produce heat to melt or burn first partition element 522 and second partition element 523, as indicated by the dotted lines. In this case, second partition element 523 may not contact the remaining partition elements. So, the melt or burn will not affect any nearby partition element of the partition elements. In turn, third solid composition 582 and fourth solid composition 583 may interact, thereby emitting smoke 660 and burning or melting away third partition element 524 and fourth partition element 525.

Figure 8:
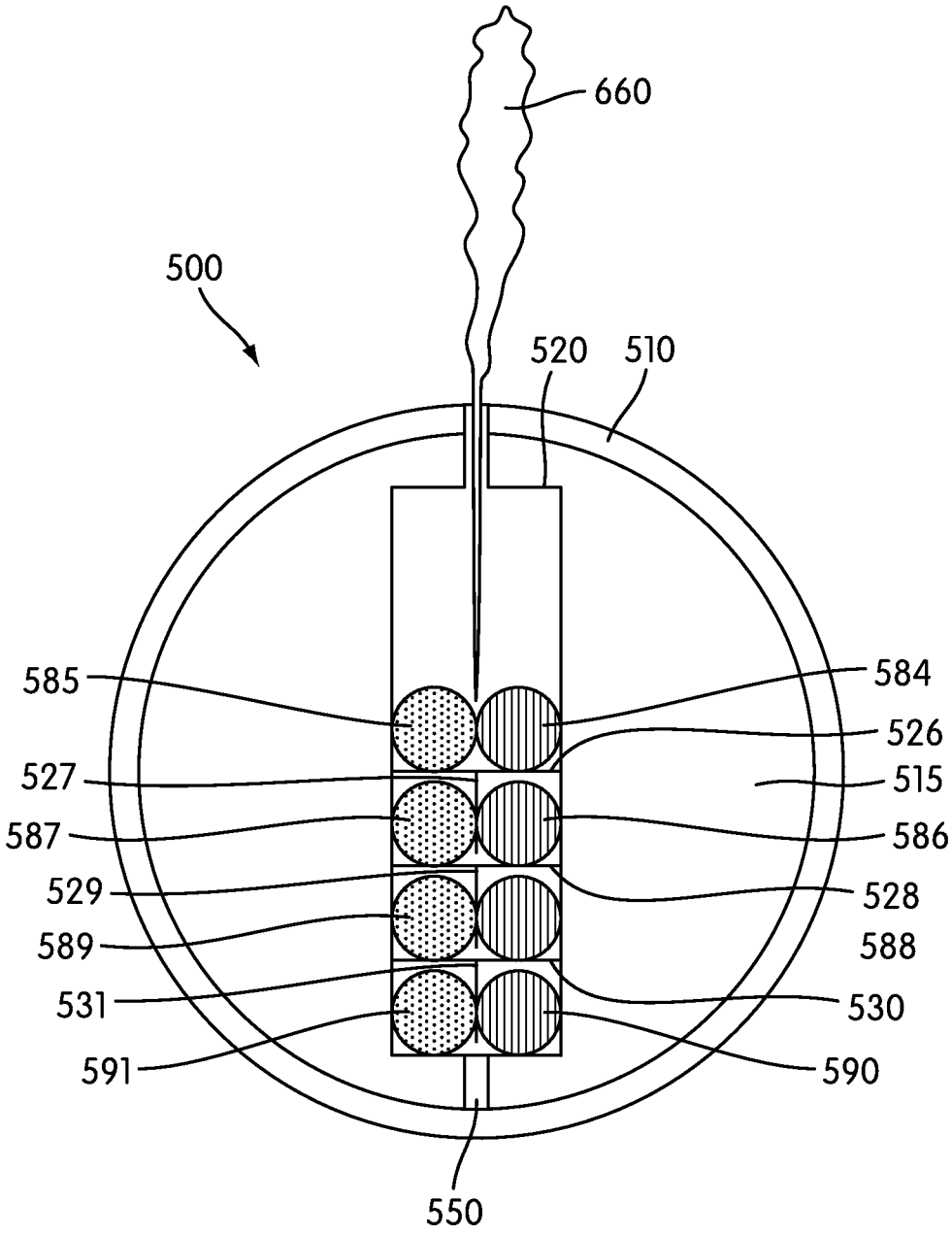
FIG. 8 shows a cross-sectional view of a golf ball as an embodiment of the invention with other partition elements fully removed.

FIG. 8 shows a cross-sectional view of a golf ball after a second chemical reaction as an embodiment of the invention. After third partition element 524 and fourth partition element 525 are removed, fifth solid composition 584 and sixth solid composition 585 may no longer be inhibited from interacting. Accordingly, after golf ball 500 has been subject to adequate pressure, fifth solid composition 584 and sixth solid composition 585 may engage in a chemical reaction. The second chemical reaction may result in the emission of smoke 660. Further, due to the heat produced by the second chemical reaction, fifth partition element 526 and sixth partition component 527 may be melted or burned away.

After a third chemical reaction, in some cases, the remaining solid compositions may react after subsequent ball strikes. Similarly, the remaining partition elements may be sequentially burned or melted away. More specifically, seventh solid composition 586 and eighth solid composition 587 may react. As a result, seventh partition element 528 and eighth partition element 529 may be burned or melted away. In another subsequent ball strike, ninth solid composition 588 and tenth solid composition 589 may react. As a result, ninth partition element 530 and tenth partition element 531 may be burned or melted away. In another subsequent ball strike, eleventh solid composition 590 and twelfth solid composition 591 may react. During each reaction, smoke 660 may be emitted from golf ball 500. In embodiments where further solid compositions exist, this pattern may continue until all solid compositions have reacted.

Figure 9:
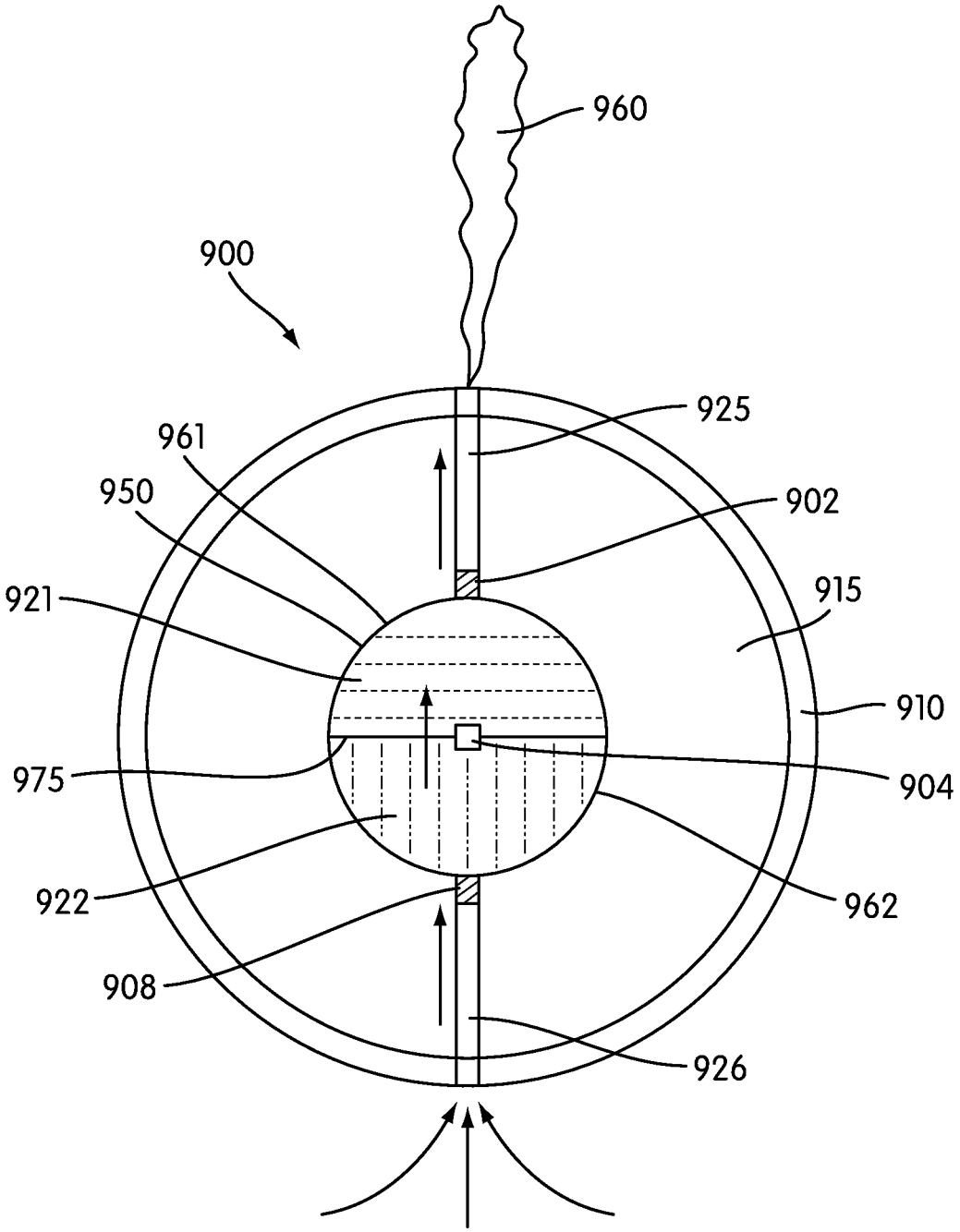
FIG. 9 shows a cross-sectional view of a golf ball as an embodiment of the invention with multiple liquid compositions.

FIG. 9 shows a cross-sectional view of a golf ball as an embodiment of the invention. Golf ball 900 may comprise a core 915 and a cover 910. A chamber 950 may comprise film 975. Film 975 may separate first chamber area 961 and second chamber area 962. In some embodiments, first chamber area 961 may contain first liquid composition 921 and second chamber area 962 may contain second liquid composition 922.

Golf ball 900 may include provisions for allowing a chemical reaction between liquid compositions. Golf ball 900 may comprise a plurality of check valves. As illustrated, first check valve 902, second check valve 904 and third check valve 908 may allow for single directional airflow and liquid flow. First check valve 902, second check valve 904 and third check valve 908 may be the same type of check valve or different types. The check valves may be any type of check valve, including but not limited to ball check valve, diaphragm check valve, swing check valve, or duckbill check valve. After golf ball 900 is struck, if a pressure threshold has been met, a predetermined amount of second liquid composition 922 will be released from second chamber area 962 through second check valve 904 to first chamber area 961. Accordingly, a predetermined amount of second liquid composition 922 may react with first liquid composition 921. In some cases, this reaction may produce smoke 960. Smoke 960 may be discharged through first check valve 902 and passage 925. Fresh air may enter golf ball 900 through passage 926 and third check valve 908. It may be appreciated that while check valve 902 and check valve 908 are located on the innermost portions of passage 925 and passage 926, respectively, the check valves may be located on any portion of the passages, including the center or outermost portions. By using only predetermined amounts of second liquid composition 922, much of second liquid composition 922 may remain in second chamber area 962. As such, golf ball 900 may emit smoke intermittently even after several strikes.

Liquid compositions may include any type of liquid composition capable of creating the desired reaction. In some cases, hydrogen bromide and sodium carbonate be reacted to create sodium bromide, carbon dioxide and water. In such cases, the chemical reaction may be $2HBr+Na_2CO_3 \rightarrow 2NaBr+CO_2+H_2O$.

Figure 10:
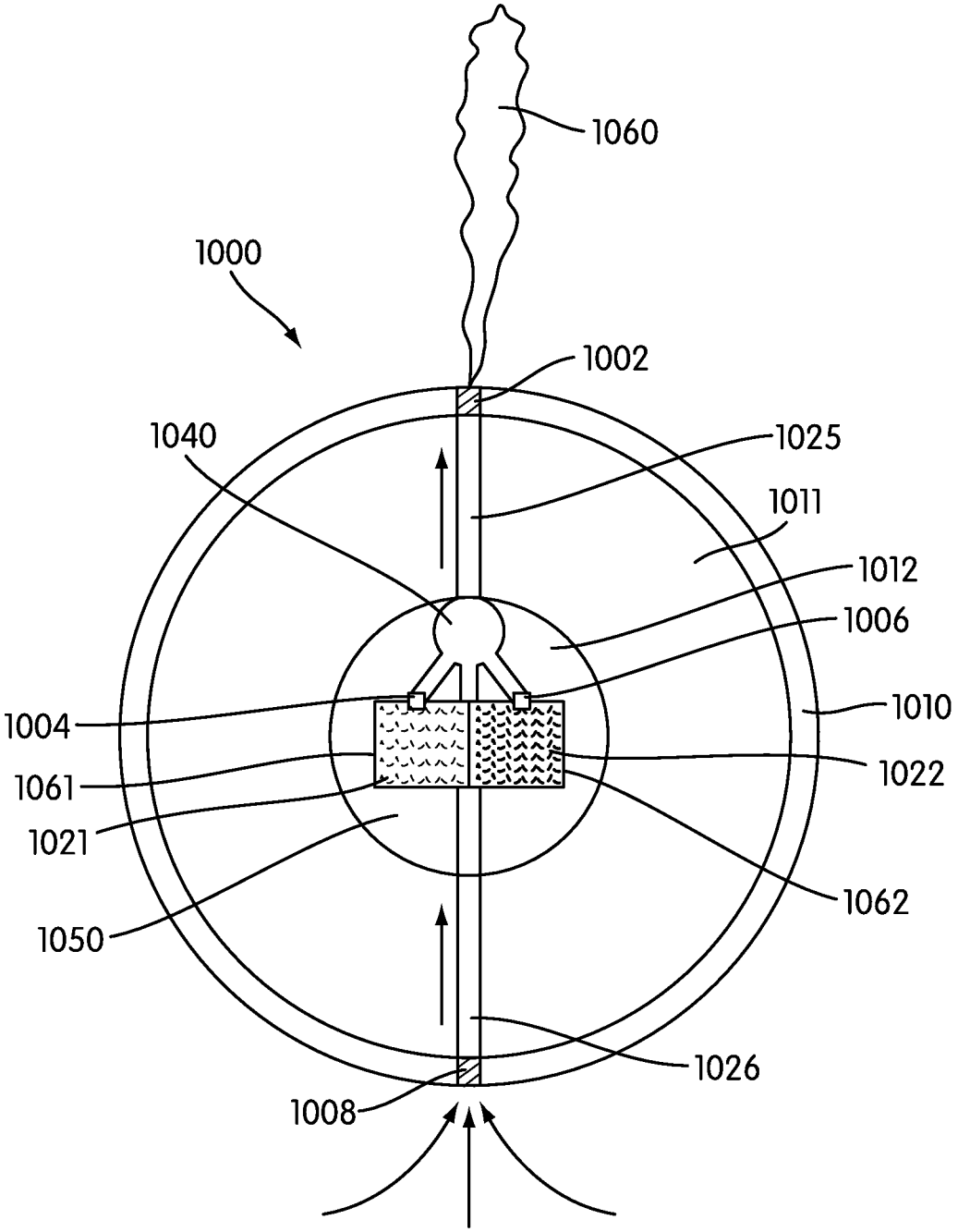
FIG. 10 shows a cross-sectional view of a golf ball as an embodiment of the invention with multiple liquid compositions and a mixing chamber.

FIG. 10 shows a cross-sectional view of a golf ball as an embodiment of the invention. In some embodiments, golf ball 1000 may comprise inner core 1012, outer core 1011 and cover 1010. Golf ball 1000 may also include chamber 1050 comprising first chamber area 1061 and second chamber area 1062. First chamber area 1061 may contain first liquid composition 1021 and second chamber area 1062 may comprise second liquid composition 1022.

Golf ball 1000 may include provisions for allowing a chemical reaction between liquid compositions. Golf ball 1000 may comprise a plurality of check valves. As illustrated first check valve 1002, second check valve 1004, third check valve 1006 and fourth check valve 1008 may allow for single directional airflow and liquid flow. First check valve 1002, second check valve 1004, third check valve 1006 and fourth check valve 1008 may be the same type of check valve or different types. As in FIG. 9, the check valves may be any type of check valve. In some embodiments, golf ball 1000 may include a mixing space 1040. After golf ball 1000 is struck, if a pressure threshold has been met, a predetermined amount of second liquid composition 1022 may be released from second chamber area 1062 into mixing area 1040 by check valve 1006. Similarly, a predetermined amount of first liquid composition 1021 may be released from first chamber area 1061 by second check valve 1004. Accordingly second liquid composition 1022 may react with first liquid composition 1021. In some cases, this reaction may produce smoke 1060. Smoke 1060 may be discharged through first check valve 1002 and passage 1025. Fresh air may enter golf ball 1000 through passage 1026 and fourth check valve 1008. By releasing only predetermined amounts, much of first liquid composition 1021 and second liquid composition 1022 may remain in first chamber area 1061 and second chamber area 1062, respectively. As such, golf ball 1000 may emit smoke intermittently even after several strikes.

Figure 11:
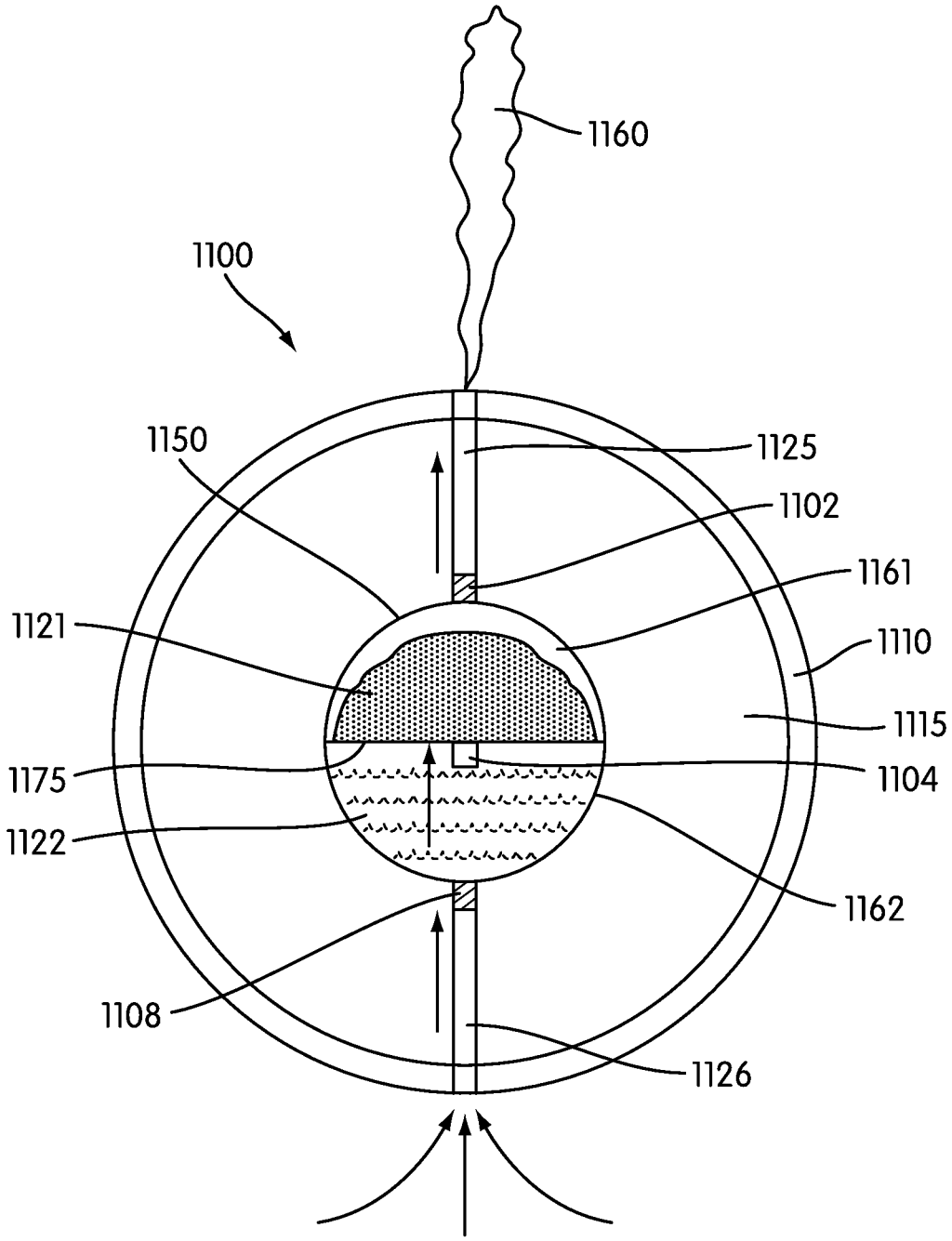
FIG. 11 shows a cross-sectional view of a golf ball as an embodiment of the invention with a liquid composition and a solid composition.

FIG. 11 shows a cross-sectional view of a golf ball as an embodiment of the invention. Golf ball 1100 may comprise core 1115 and cover 1110. Chamber 1150 may be separated by a film 1175 into first chamber area 1161 and second chamber area 1162. First chamber area 1161 may contain solid composition 1121. Second chamber area 1162 may contain liquid composition 1122.

Golf ball 1100 may include provisions for allowing a chemical reaction between a liquid composition and a solid composition. Generally, golf ball 1100 may comprise a plurality of check valves. As illustrated first check valve 1102, second check valve 1104, and third check valve 1108 may allow for single directional airflow and liquid flow. First check valve 1102, second check valve 1104 and third check valve 1108 may be the same type of check valve or different types. As in FIGS. 9 and 10, they may be any type of check valve. After golf ball 1100 is struck, if a pressure threshold has been met, a predetermined amount of liquid composition 1122 may be released from second chamber area 1162 into first chamber area 1161 through second check valve 1104. Accordingly liquid composition 1122 may react with solid composition 1121. It will be appreciated that solid composition 1121 may be in a form of fine powder or pellet, similar to the solid compositions of FIGS. 5-8. In some cases, this reaction may produce smoke 1160. Smoke 1160 may be discharged through first check valve 1102 and passage 1125. Fresh air may enter golf ball 1100 through passage 1126 and third check valve 1108. By using only predetermined amounts, much of liquid composition 1122 may remain in second chamber area 1162. As such, golf ball 1100 may emit smoke intermittently even after several strikes.

The liquid compositions and solid compositions may be any type of composition known to create the desired effects. In some embodiments, hydrogen peroxide with a catalyst such as manganese dioxide may produce water and oxygen gas. In other embodiments, calcium carbonate and hydrochloric acid may produce carbon dioxide, water and calcium chloride. In other embodiments, zinc and hydrochloric acid may produce zinc chloride and hydrogen gas. In other embodiments, calcium and water may produce calcium hydroxide and hydrogen gas. In other embodiments, sodium bicarbonate and hydrochloric acid may produce sodium chloride, water, and carbon dioxide. In other embodiments, nitric acid and copper may produce copper nitrate, water and nitrogen dioxide. Accordingly, some reaction examples include, but are not limited to the following:

$$4H_2O_2 \xrightarrow{MnO_2} 2H_2O + O_2$$

$$CaCO_3 + 2HCl \longrightarrow CO_2 + H_2O + CaCl_2$$

$$Zn + 2HCl \longrightarrow ZnCl_2 + H_2$$

$$Ca + 2H_2O \longrightarrow Ca(OH)_2 + H_2$$

$$NaHCO_3 + HCl \longrightarrow NaCl + H_2O + CO_2$$

$$4HNO_3 + Cu \longrightarrow Cu(NO_3)_2 + 2H_2O + 2NO_2$$

Figure 12:
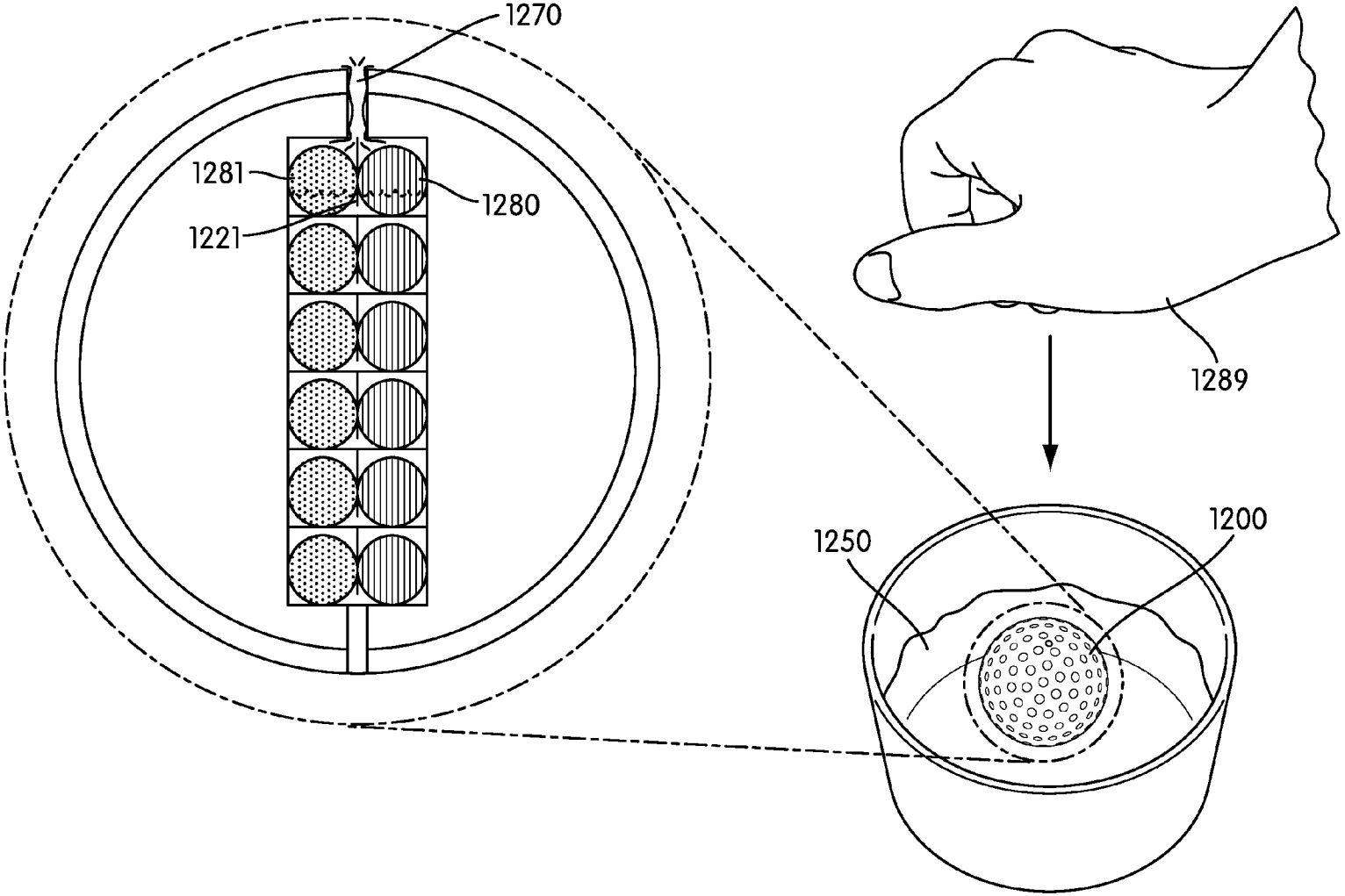
FIG. 12 schematically shows a user removing a removable partition using a first embodiment of a manual technique.

FIGS. 12-15 illustrate various embodiments for completing step 310 of FIG. 3. FIG. 12 shows a schematic and cross-sectional view of a golf ball. Golf ball 1200 may include provisions for removing a removable partition element. In one embodiment, removable partition element 1221 may be capable of being dissolved in a solution 1250. In some cases, the solution may be water, but the embodiment is not limited to any type of solution. When golf ball 1200 is placed into solution 1250, some of the solution 1270 may seep into an aperture on golf ball 1200. Accordingly, when solution 1270 comes into contact with removable partition element 1221, removable partition element 1221 may be dissolved. At this point, first solid composition 1280 and second solid composition 1281 are not inhibited from interacting. In some cases, golfer 1289 may be required to place golf ball 1200 into solution 1250 for a particular amount of time to assure that removable partition element 1221 has been removed. In other cases, if golf ball 1200 is placed into solution 1250 for a certain amount of time, other partition elements may be removed. In other cases, the other partition elements may not be capable of being dissolved in solution 1250.

Figure 13:
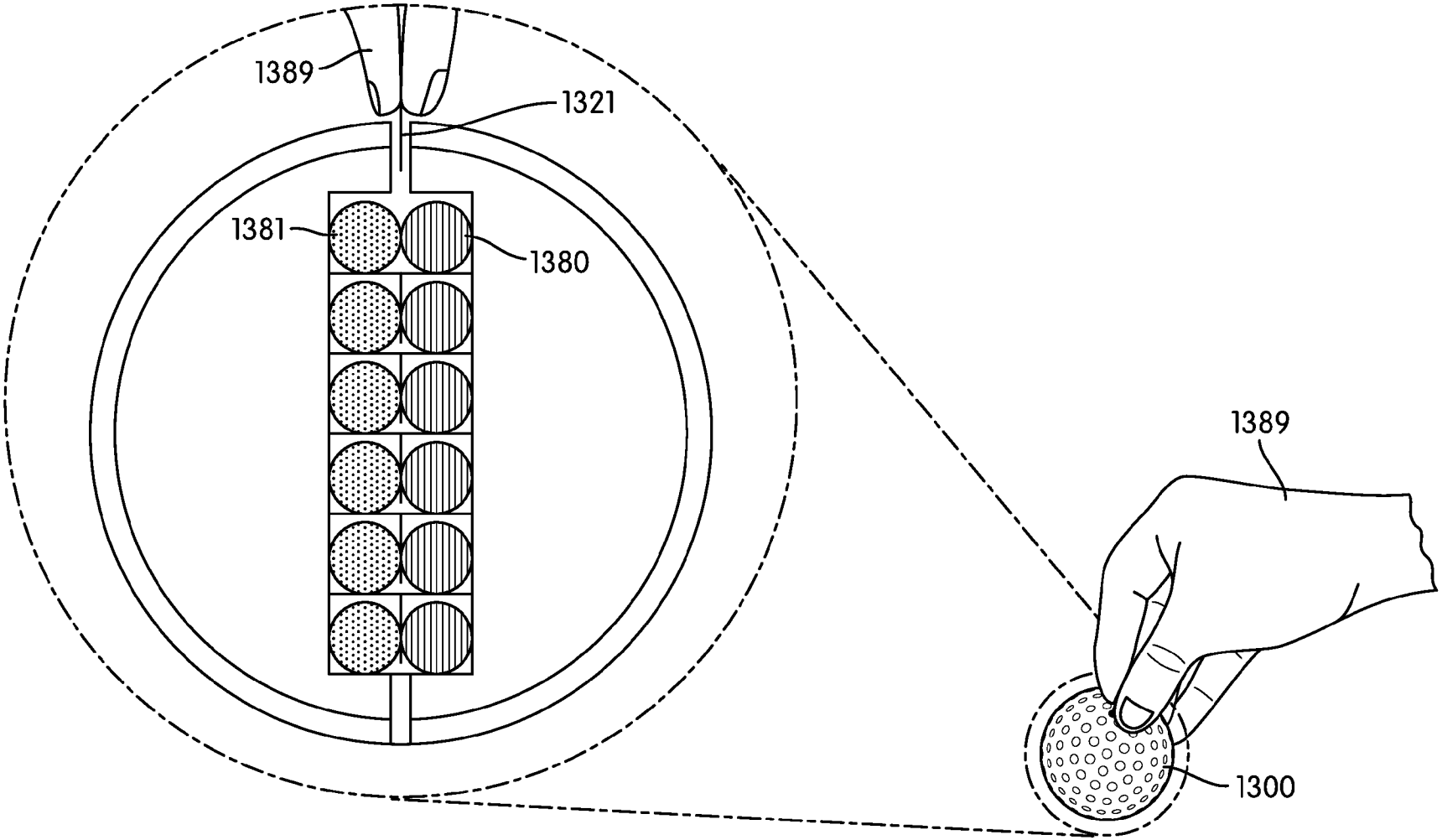
FIG. 13 schematically shows a user removing a removable partition using a second embodiment of a manual technique.

FIG. 13 similarly shows a schematic and cross-sectional view of a golf ball. Golf ball 1300 may include provisions for removing a removable partition element 1321. In one embodiment, removable partition element 1321 may be capable of being pulled out of ball 1300 by golfer 1389. In such cases, once removable partition element 1321 has been removed, first solid composition 1380 and second solid composition 1381 may not be inhibited from reacting. Accordingly, golf ball 1300 may smoke after golf ball 1300 is struck. In other cases, removable partition element 1321 may extend through golf ball 1300, providing a barrier between each set of solid compositions. Accordingly, golfer 1389 may be able to pull removable partition element 1321 various distances resulting in one, two, three or any number of sets of solid compositions to have a removed partition, allowing them to react after golf ball 1300 is struck.

Figure 14:
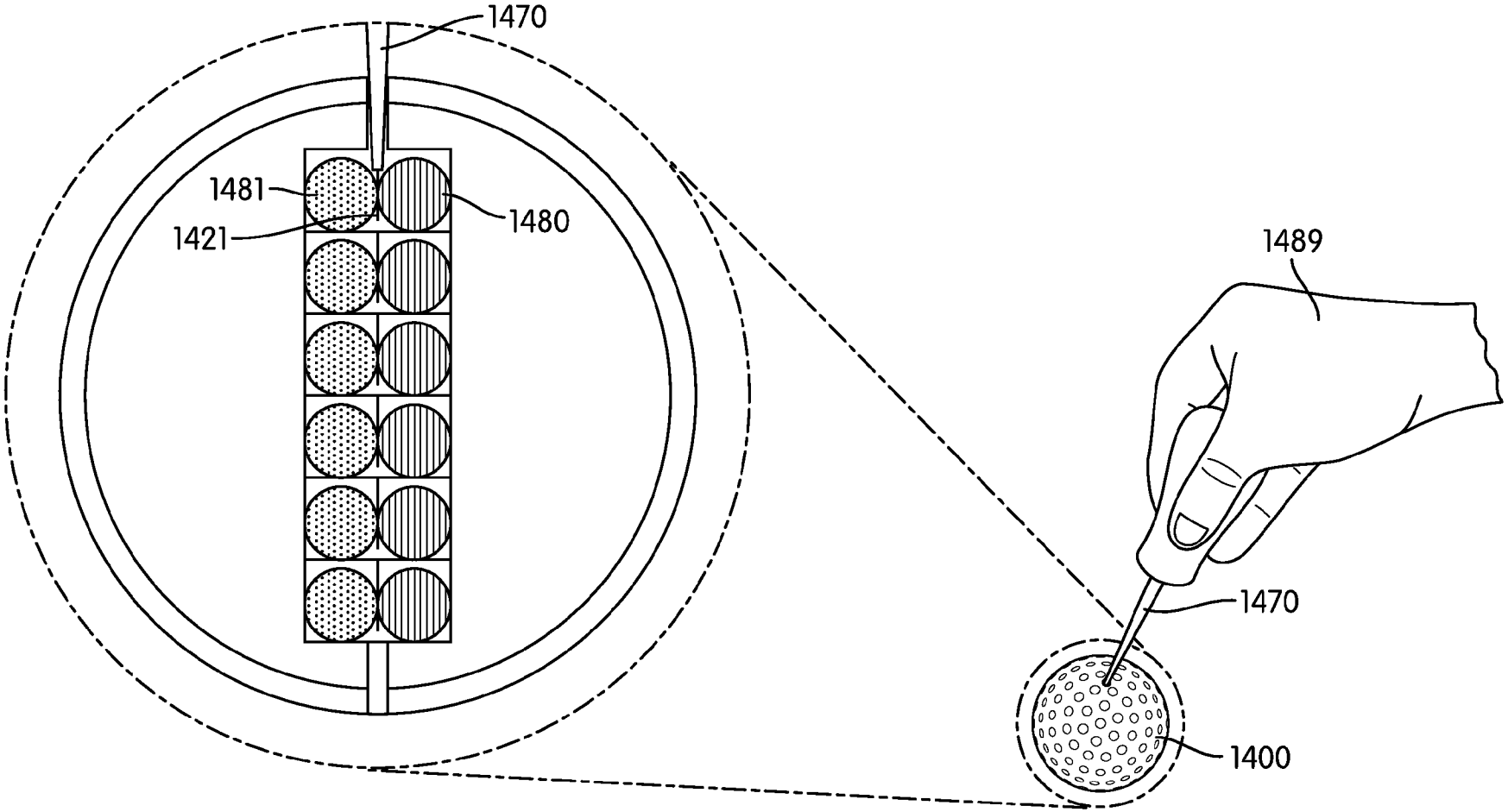
FIG. 14 schematically shows a user removing a removable partition using a third embodiment of a manual technique.

FIG. 14 similarly shows a schematic and cross-sectional view of a golf ball. Golf ball 1400 may include provisions for removing a removable partition element. In one embodiment, removable partition element 1421 may be capable of being removed by user 1489 using tool 1470. In some cases, tool 1470 may be used to push removable partition element 1421 so it condenses or otherwise folds away so it is no longer a barrier between first solid composition 1480 and second solid composition 1481. Accordingly, first solid composition 1480 and second solid composition 1481 may be cable of reacting after golf ball 1400 is struck. In other cases, removable partition element 1421 may extend through golf ball 1400, providing a barrier between each set of solid compositions. Accordingly, golfer 1489 may be able to push or pull removable partition element 1421 various distances resulting in one, two, three or any number of sets of solid compositions to have a removed partition, allowing them to react after golf ball 1400 is struck.

Tool 1470 can be any type of tool made from any type of material. In some cases, tool 1470 is a custom tool made solely for this purpose. In other cases, tool 1470 may be a standard household or golf item including, but not limited to, a screwdriver, a pencil, golf tee, or a pin.

Figure 15:
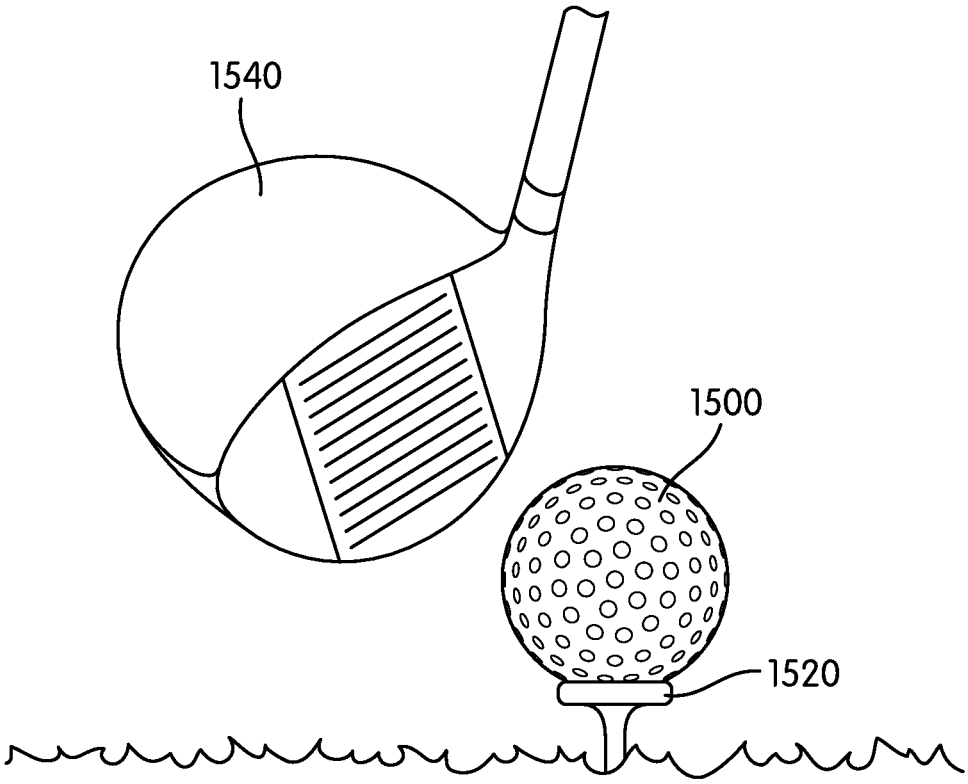
FIGS. 15-16 schematically show an embodiment of a sequence of a golf ball being placed under pressure from a golf club.
Figure 16:
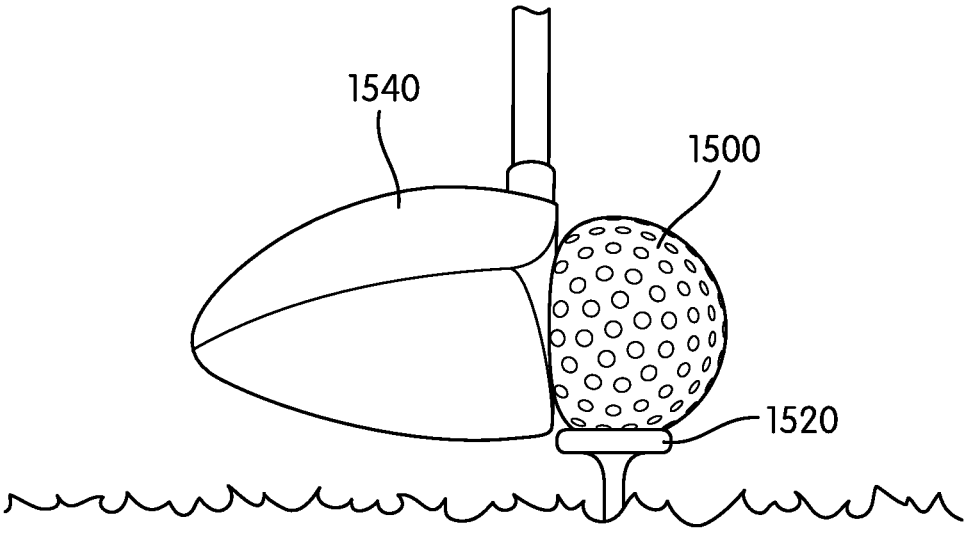

FIGS. 15-16 schematically show embodiments of golf balls configured to intermittently emit smoke being placed under pressure from a golf swing. FIG. 15 shows golf ball 1500 placed on a tee 1520 prior to impact of golf club 1540. As shown, golf ball 1500 may be in a substantially spherical shape. Accordingly, the pressure inside golf ball 1500 may be well below a threshold pressure. Therefore, even if a removable partition element has been removed or a check valve is ready to be released, there may be no chemical reaction and golf ball 1500 may not emit any smoke.

FIG. 16 shows golf ball 1500 the moment after impact with golf club 1540. As shown, golf ball 1500 may be compacted by the force of golf club 1540. The compaction may cause a large amount of pressure in golf ball 1500. In some cases, the pressure generated by the strike may surpass a threshold pressure that causes solid compositions without a barrier to react. Alternatively, the pressure may similarly surpass a threshold pressure, but instead cause liquid composition to be released through one or more check valves. In either case, a chemical reaction may result and, ultimately, golf ball 1500 may begin to emit smoke. In some cases, the smoke emission may not occur immediately. Instead, the smoke may occur after golf ball 1500 is in flight or after golf ball 1500 has landed.

Figure 17:
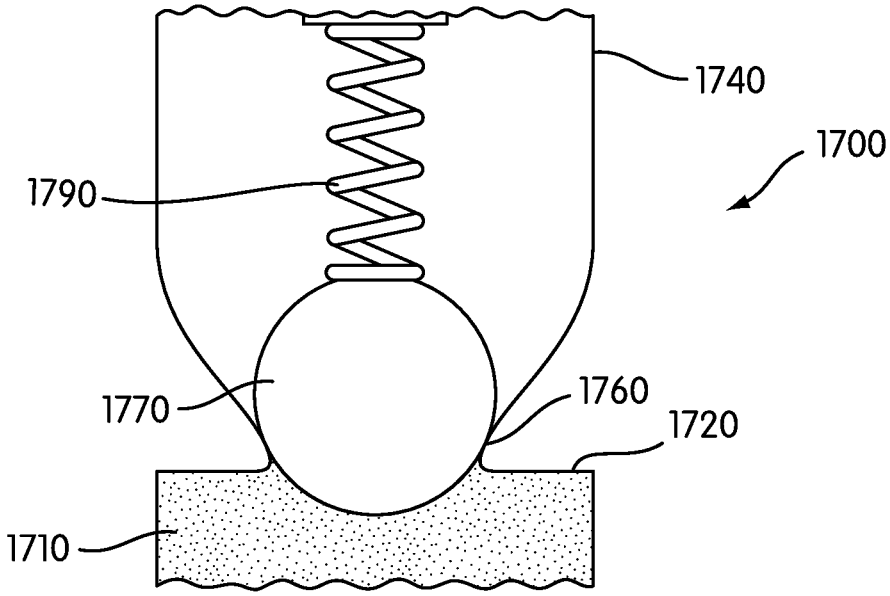
FIG. 17 shows a cross sectional view of a check valve prior to a threshold pressure being met.

FIG. 17 shows a cross-sectional view of a check valve without threshold pressure being applied. Check valve 1700 may be representative of any or all check valves shown in FIGS. 9-11. As illustrated, check valve 1700 is a ball check valve. However, it will be appreciated that in other embodiments any type of check valve may be used. Check valve 1700 may include fluid entering portion 1720 and fluid exiting portion 1740. Conically-tapered portion 1760 may be blocked by ball 1770, which is held into place by spring 1790. It will be appreciated that liquid composition 1710 may not enter conically-tapered portion 1760 while it is being blocked by ball 1770.

When pressure between fluid entering portion and fluid exiting portion are substantially similar, ball 1770 may remain blocking conically-tapered portion. Also, when pressure in fluid exiting portion 1740 is greater than the pressure of fluid entering portion, ball 1770 may remain pressed against conically-tapered portion 1760 preventing air or fluid from either side to pass conically-tapered portion 1760.

Figure 18:
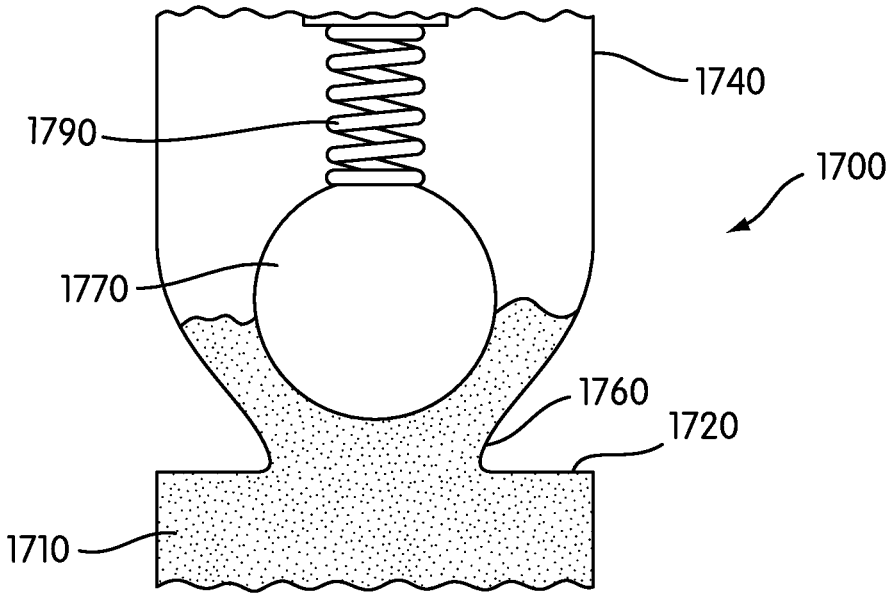
FIG. 18 shows a cross sectional view of a check value after a threshold pressure has been met.

FIG. 18 shows a cross-sectional view of the check valve of FIG. 17 with threshold pressure being applied. Fluid may only pass from fluid entering portion 1720 to fluid exiting portion 1740 when the pressure in fluid entering portion 1720 is greater than the pressure of fluid exiting portion 1740. In other cases, the pressure may need to exceed a threshold pressure difference. Under such circumstances, spring 1790 may condense allowing ball 1770 to be pushed away from conically-tapered portion 1760. Accordingly, liquid composition 1710 may be released through check valve 1700. At this point, liquid composition 1710 may be capable of combining with other compositions, causing a chemical reaction that may result in the emission of smoke.

Figure 19:
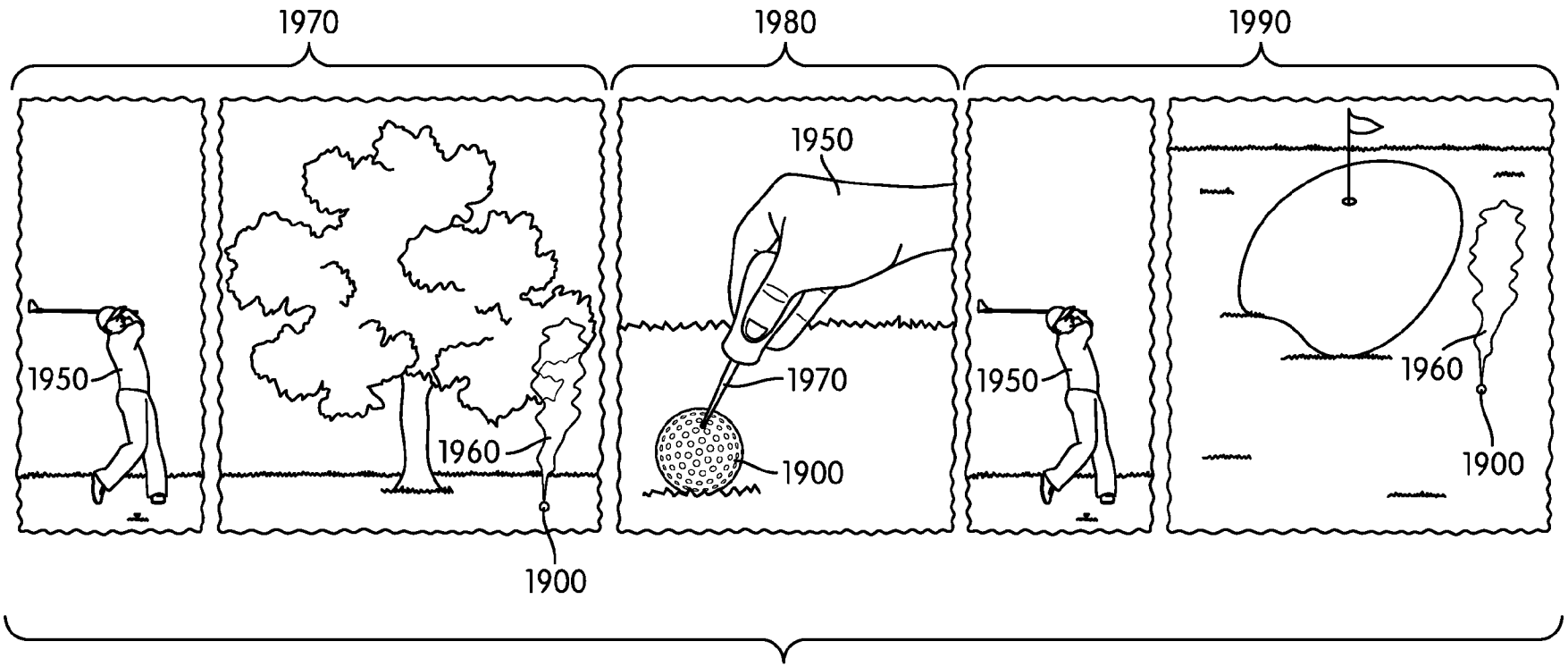
FIG. 19 shows a schematic view of a golfer using a golf ball capable of emitting smoke intermittently.

FIG. 19 shows a schematic view of a golfer using a golf ball capable of emitting smoke intermittently. The illustration includes three panels: panel 1970, panel 1980, and panel 1990. Panel 1970 shows a golfer 1950 hitting a golf ball 1900. Golf ball 1900 emits smoke 1960 subsequent to the hit. In some embodiments, the emission of smoke 1960 may result from a combination of solid or liquid compositions.

Panel 1980 shows a golfer 1950 using a tool 1970 to remove a removable partition in golf ball 1980. It may be appreciated that in some cases a tool 1970 may not be necessary to remove a removable partition. In some embodiments, other techniques shown in FIGS. 12-14 may be used to manually remove the removable partition. The manual removal of the removable partition may be an optional step. In other cases, the chemical reaction resulting from the strike in panel 1970 may have automatically removed one or more other partitions.

Panel 1990 shows a golfer 1950 hitting a golf ball 1900 a second time. Golf ball 1900 may again emit smoke 1960 subsequent to the hit. Again, in some embodiments, the emission of smoke 1960 may result from a combination of solid or liquid compositions. While only two hits and emissions of smoke are shown, it will be appreciated that golf ball 1900 may be capable of further emissions of smoke on subsequent strikes.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

The invention claimed is:

1. A golf ball capable of emitting smoke, the golf ball comprising:

a cover;

a core;

a chamber, wherein a first portion of the chamber comprises a first composition and a second portion of the chamber comprises a second composition;

one or more check valves, wherein the one or more check valves may release a portion of the first composition from the first portion of the chamber into an area where the portion of the first composition is combined with at least a portion of the second composition;

wherein the combination of the first composition and the second composition causes an emission of smoke;

wherein the golf ball is configured to emit smoke after each of multiple strikes.

2. The golf ball of claim 1, wherein the second composition comprises a liquid composition.

3. The golf ball of claim 1, wherein the second composition comprises a solid composition.

4. The golf ball of claim 1, wherein the at least one check valve does not open unless an internal golf ball pressure exceeds a predetermined threshold pressure.

5. The golf ball of claim 1, wherein the area comprises a mixing chamber.

6. A golf ball comprising:

a cover;

a core;

a chamber, wherein the chamber comprises a plurality of solid compositions;

one or more removable partitions elements;

one or more other partition elements;

wherein a striking of the golf ball causes a chemical reaction that generates smoke;

wherein at least one of the removable partition elements is configured to be removed prior to striking the golf ball to cause the chemical reaction;

wherein the golf ball is capable of emitting smoke after multiple strikes.

7. The golf ball of claim 6, wherein the chemical reaction removes one or more of the other partition elements.

8. The golf ball of claim 6, wherein the chemical reaction occurs when the striking of the golf ball causes a predetermined threshold pressure to be met.

9. The golf ball of claim 6, wherein the removable partition element is configured to be removed by being dissolved in a solution.

10. The golf ball of claim 6, wherein the removable partition element may be removed by a user manually.

11. The golf ball of claim 6, wherein the removable partition element is configured to be removed by being pulled out of the ball or by using a tool.

* * * * *